US009084495B2

(12) United States Patent
Ing et al.

(10) Patent No.: US 9,084,495 B2
(45) Date of Patent: Jul. 21, 2015

(54) DEBRIS CATCHING APPARATUS

(71) Applicants: Danny Ing, Redondo Beach, CA (US); Lisa Krohn, Los Angeles, CA (US)

(72) Inventors: Danny Ing, Redondo Beach, CA (US); Lisa Krohn, Los Angeles, CA (US)

( * ) Notice: Subject to any disclaimer, the term of this patent is extended or adjusted under 35 U.S.C. 154(b) by 0 days.

(21) Appl. No.: 14/148,415

(22) Filed: Jan. 6, 2014

(65) Prior Publication Data

US 2014/0319887 A1 Oct. 30, 2014

Related U.S. Application Data

(60) Provisional application No. 61/749,203, filed on Jan. 4, 2013.

(51) Int. Cl.
*A47D 15/00* (2006.01)
*A47D 1/00* (2006.01)

(52) U.S. Cl.
CPC ..... *A47D 15/00* (2013.01); *A47D 1/008* (2013.01)

(58) Field of Classification Search
CPC ..... A47C 1/04; A47D 1/008
USPC ..... 297/188.08, 188.12, 188.13, 188.2, 297/219.12, 182
See application file for complete search history.

(56) References Cited

U.S. PATENT DOCUMENTS

| | | | | | |
|---|---|---|---|---|---|
| 837,570 | A * | 12/1906 | Jackson | 297/182 |
| 2,585,434 | A * | 2/1952 | Caponera | 297/182 |
| 2,827,953 | A * | 3/1958 | Jones | 297/182 |
| 2,938,574 | A * | 5/1960 | Brown | 297/182 |
| 3,298,736 | A * | 1/1967 | Decker | 297/182 |
| 4,094,547 | A * | 6/1978 | Zampino et al. | 297/182 |
| 5,549,353 | A * | 8/1996 | Gaudet et al. | 297/182 |
| 6,652,947 | B2 * | 11/2003 | Sweeney et al. | 428/43 |
| 6,796,606 | B2 * | 9/2004 | Marshall | 297/182 |
| 7,717,504 | B2 * | 5/2010 | Centracco et al. | 297/136 |
| 7,891,731 | B2 * | 2/2011 | O'Toole | 297/182 |
| 8,042,241 | B2 * | 10/2011 | McConnell et al. | 29/91.1 |
| 8,840,177 | B2 * | 9/2014 | Ballard et al. | 297/182 |
| 2002/0037387 | A1 * | 3/2002 | Sweeney et al. | 428/43 |
| 2008/0185881 | A1 * | 8/2008 | Romaniuk et al. | 297/182 |
| 2009/0127917 | A1 * | 5/2009 | Foenander | 297/463.1 |

* cited by examiner

*Primary Examiner* — Laurie Cranmer

(57) ABSTRACT

A debris catching apparatus which has an inner rim, a receiver, an outer rim, an outer lip, a top fastening mechanism, and a bottom fastening mechanism. The apparatus is attachable to a chair to catch food debris dropped or thrown by a child.

1 Claim, 5 Drawing Sheets

DEBRIS CATCHING APPARATUS

This application claims priority to U.S. Provisional Application No. 61/749,203, filed Jan. 4, 2013, incorporated entirely by reference.

BACKGROUND

The present disclosure relates generally to chairs and seats. In particular, debris catching apparatuses for children's highchairs. Young children relegated to the confines of a highchair during meal times invariably drop, spill, or even throw foodstuff onto the floor and other nearby surfaces. Parents and others are often tasked with coming in and cleaning up after the child once they've finished their meal. This may include not only picking up the thrown foodstuff, but sweeping and mopping the floor as well. A common way of protecting the floor is to place a mat or sheet under the child and the chair. However, cleaning this mat or sheet can be just as tedious and time consuming as cleaning the floor.

An alternative method for dealing with this dilemma is to attach some sort of device to the highchair that catches the thrown or dropped foodstuff. However, many of these devices are limited to catching the discarded foodstuff in a certain place, and even when the foodstuff is caught, that device still needs to be thoroughly cleaned. The cleaning of these conventional types of apparatuses are often just as labor intensive and time consuming as cleaning the floor or even a mat or a sheet placed under the child's highchair.

Known debris catching apparatuses are not entirely satisfactory for the range of applications in which they are employed. For example, existing debris catching apparatuses are not easily adjustable to fit a wide variety of children's highchairs. In addition, conventional debris catching apparatuses are not conveniently portable nor are they machine washable.

Thus, there exists a need for debris catching apparatuses that improve upon and advance the design of known debris catching apparatuses. Examples of new and useful debris catching apparatuses relevant to the needs existing in the field are discussed below.

DESCRIPTION

The disclosed debris catching apparatuses will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, a variety of debris catching apparatus examples are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

Figure 1:
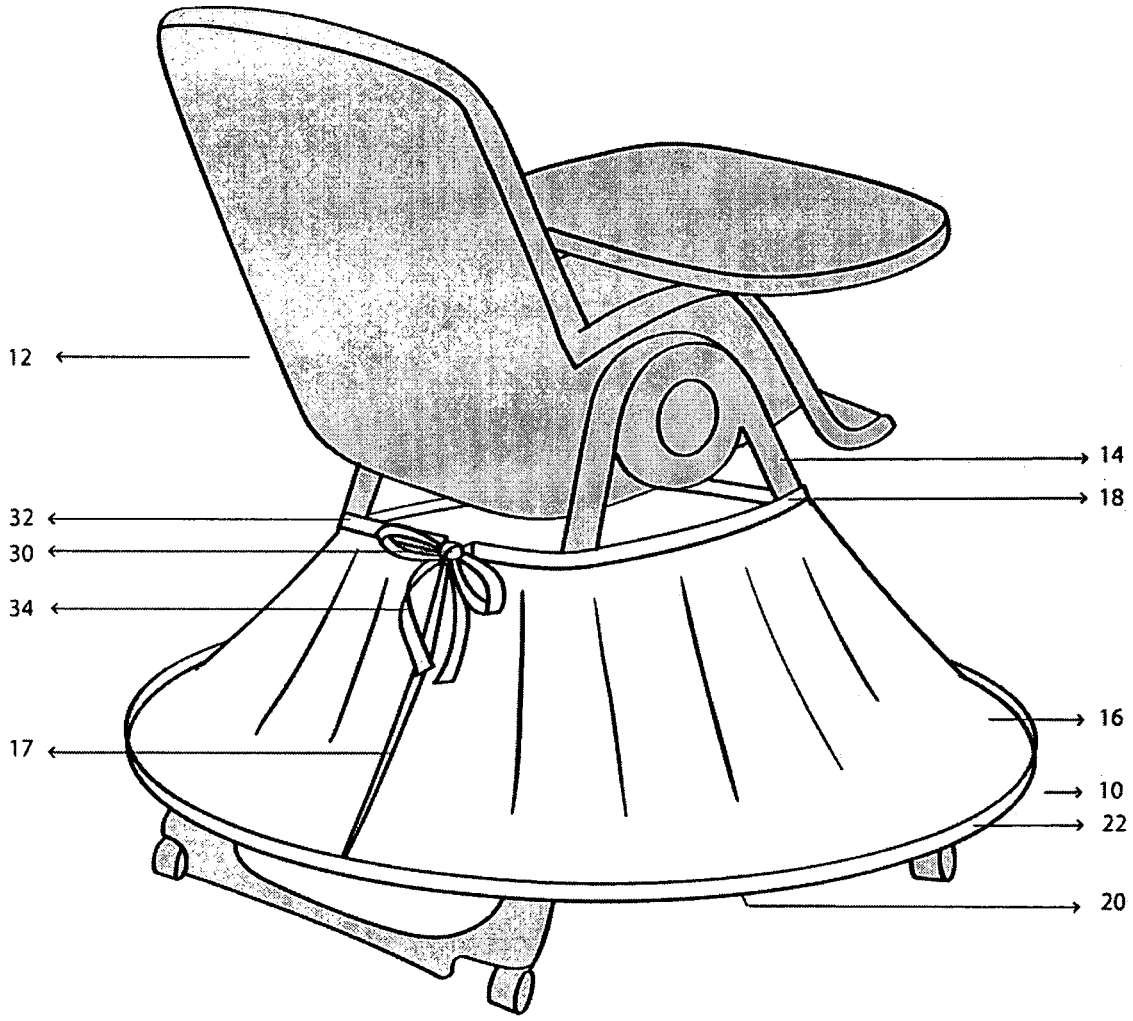
FIG. 1 is a rear perspective view of a first example of a debris catching apparatus.
Figure 2:
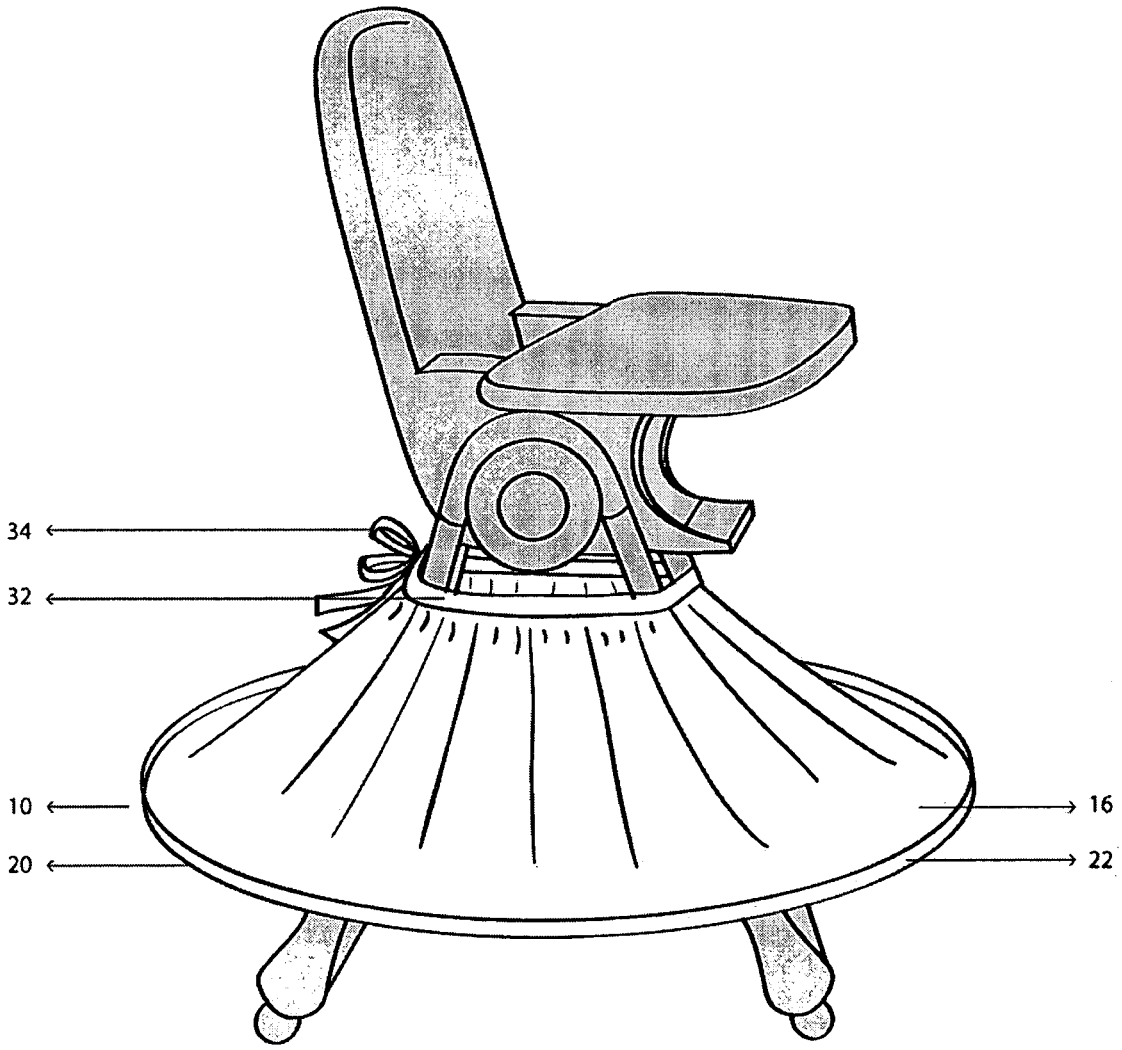
FIG. 2 is a left-side perspective view of the debris catching apparatus shown in FIG. 1.
Figure 3:
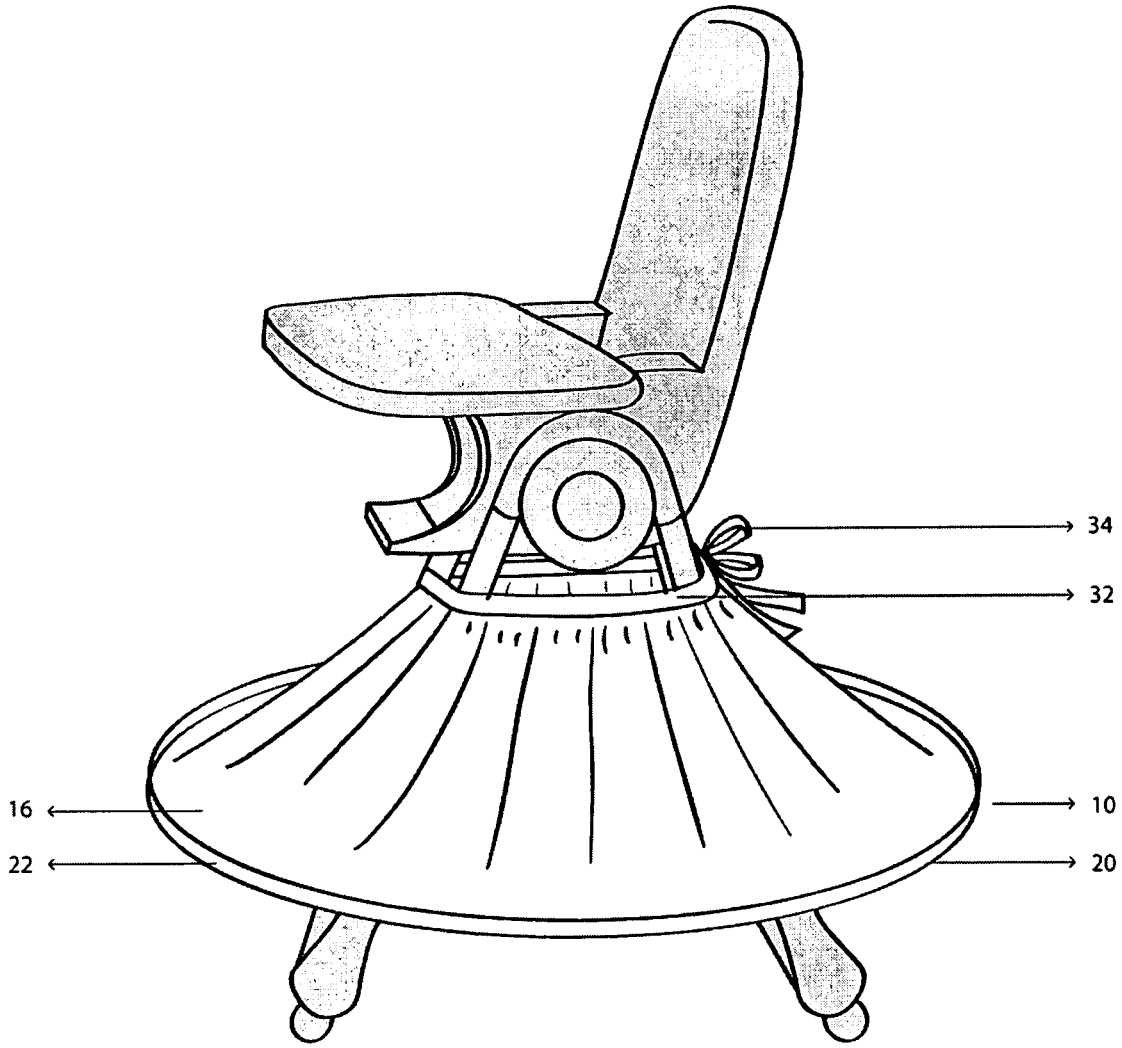
FIG. 3 is a right-side perspective view of the debris catching apparatus shown in Fig.

With reference to FIG. 1, a debris catching apparatus 10 includes a receiver 16, an inner rim 18, an outer rim 20, an outer lip 22, and a top fastening mechanism 30. Debris catching apparatus 10 functions to attach to a chair 12 in a manner that substantially surrounds the perimeter chair 12 in order to catch any falling or thrown foodstuff.

In use, a user may secure apparatus 10 to a high chair to catch dropped or thrown food. After a meal or on a periodic or as-needed basis, the user may wipe down receiver 16 with a wet cloth. Any food collected by receiver 16 will be collect against outer rim 20, which enables the user to readily transfer the food to a waste bin.

In one embodiment, the user can readily remove apparatus 10 from the high chair and wash apparatus in a washing machine, or sink.

As can be seen in FIGS. 1-4, receiver 16 is an expanse of material extending between inner rim 18 and outer rim 20. A rear opening 17 extends from an opening in inner rim 18 downward towards outer rim 20 and allows apparatus 10 to easily encircle the lower portion of a chair 12, which in turn allows apparatus 10 to be attached to legs 14 of chair 12. In other embodiments, the debris catching apparatus may be attached to the base of the chair or any other portion of the chair that is located near the chair's seat, beneath where a child will sit. For example, at a restaurant, the debris catching apparatus could be secured near the base of a booster seat set on a conventional chair.

In one embodiment, receiver 16 is a singularly constructed piece of material and is attached to chair 12 through rear opening 17. Upon proper mounting of apparatus 10, rear opening 17 becomes substantially closed. In one embodiment, receiver 16 is manufactured from ripstop nylon. Alternatively, the receiver may be made from a washable-type material including, but not limited to, polyethylene vinyl acetate (PEVA). In yet another embodiment, the receiver may also be made from a disposable material, such as wax paper.

When apparatus 10 is affixed to legs 14, receiver 16 is able to naturally extend a substantial distance beyond the outer perimeter of chair 12 due to the circumference of outer rim 20 being greater than the circumference of inner rim 18. In one embodiment, the shape of apparatus 10 when affixed to chair 12 is substantially circular. In other embodiments, the apparatus may be of a variety of different shapes including, but not limited to, elliptical, rectangular and irregular.

Figure 4:
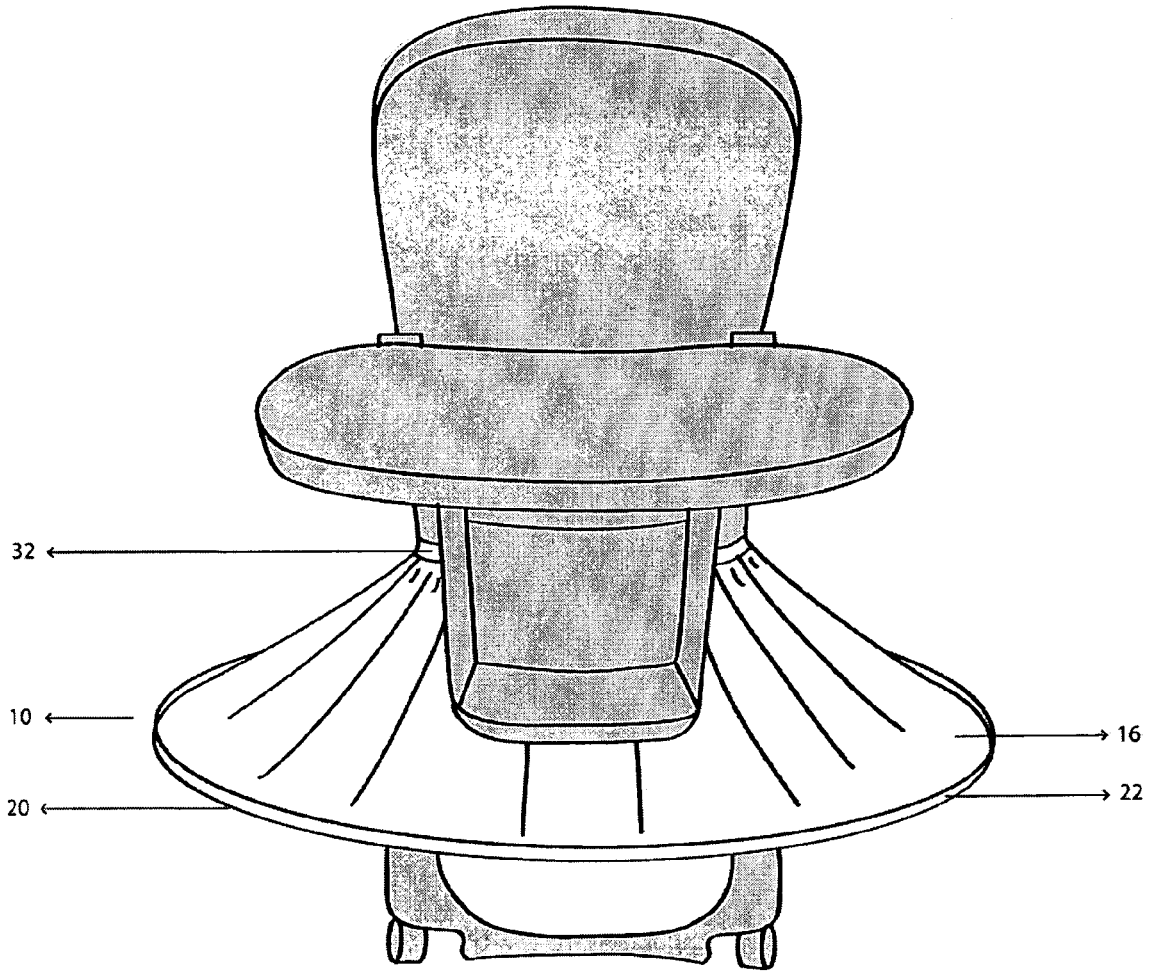
FIG. 4 is a front perspective view of the debris catching apparatus shown in FIG. 1.

In reference to FIGS. 1 and 4, outer rim 20 further defines an outer lip 22 that extends rigidly upward due to a rigid insert (not shown) sewn into a fabric seam of outer lip 22. More specifically, rigid insert is secured between the folds of a strip of material that constitutes outer lip 22 and completely traverses the circumference of outer rim 20 while functioning to collect any foodstuff that falls onto receiver 16. In other embodiments, the outer lip extends around a portion of the outer rim and the rigid insert is attached to the exterior of the outer lip instead of being sewn into a fabric seam. In still further embodiments, the outer rim includes multiple sections spaced from one another, such as a front section and a rear section and/or side sections.

In one embodiment, rigid insert is made from a plastic material. Alternatively, the rigid material may be made from any other known or later developed lightweight, pliable material.

With continuing reference to FIG. 1, a top fastening mechanism 30 functions to secure inner rim 18 of apparatus 10 to chair 14. Top fastening mechanism 30 further includes a drawstring sleeve 32 and a drawstring 34. Drawstring sleeve 32 is a sewn-in fabric seam disposed adjacent inner rim 18 and substantially traverses the circumference of inner rim 18. Drawstring sleeve 32 is configured to receive drawstring 34. Drawstring 32 functions to tighten inner rim 18 around legs 14, securely mounting apparatus 10 to chair 12. Alternatively, in other embodiments, the inner rim of the debris catching apparatus may be mounted using other types of fastening mechanisms, including, but not limited to hook and loop mechanisms, and button-snapping mechanisms.

In one embodiment, outer rim 20 is not continuous and a bottom fastening mechanism functions to secure outer rim 20 of apparatus 10. The bottom fastening mechanism may further include at least two hook-and-loop members disposed on opposing ends of outer rim 20. Hook-and-loop members function to close outer rim 20 of apparatus 10 by being mated to each other.

In a further embodiment, the bottom fastening mechanism is configured to allow adjustment of the circumference of outer rim 20. Opposing ends of outer rim 20 can be adjustably secured closer together, thereby decreasing the circumference, or adjustably secured further apart, allowing for the circumference to be increased. Thus, apparatus 10 may be adjustable to a variety of chairs having different shapes and sizes. Alternatively, in other embodiments, the outer rim of the debris catching apparatus may be closed using other types of fastening mechanisms, including, but not limited to drawstring mechanisms or button-snapping mechanisms.

In a further embodiment, as seen in FIG. 1, outer rim 20 comprises a continuous piece of material, such as spring steel, or a secured piece of material. In this embodiment, rear opening 17 does not extend all the way from inner rim 18 to outer rim 20 and there is no bottom fastening mechanism. In another embodiment, outer rim 20 may optionally be adjustable. Also in this embodiment, receiver 16 may either have rear opening 17 or be continuous with no opening. Inner rim 18 is substantially as described previously.

The disclosure above encompasses multiple distinct inventions with independent utility. While each of these inventions has been disclosed in a particular form, the specific embodiments disclosed and illustrated above are not to be considered in a limiting sense as numerous variations are possible.

Where the disclosure or subsequently filed claims recite "a" element, "a first" element, or any such equivalent term, the disclosure or claims should be understood to incorporate one or more such elements, neither requiring nor excluding two or more such elements.

Example 1

Attaching Bib to Highchair

Figure 5A:
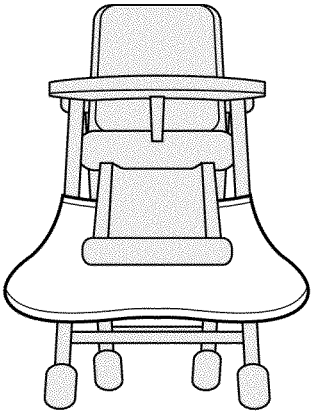
FIGS. 5A, 5B, 5C, 5D, 5E are a front perspective view of the debris catching apparatus during attachment and after attachment to a high chair.
Figure 5B:
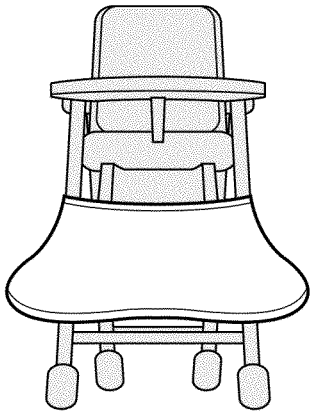
Figure 5C:
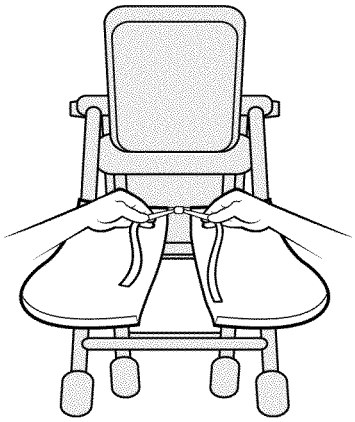
Figure 5D:
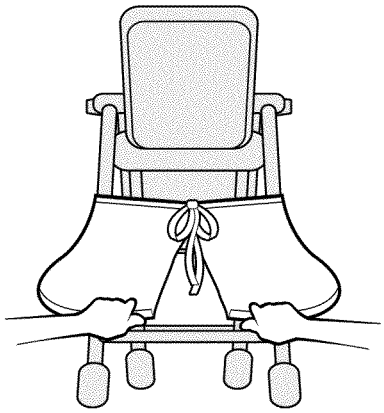
Figure 5E:
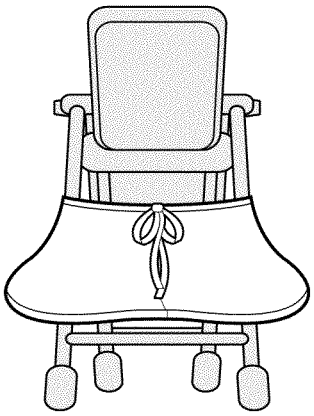
Figure 5F:
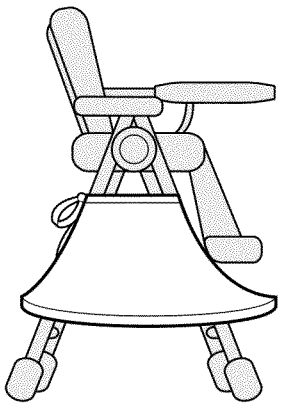
FIG. 5F is a side perspective view.

In an embodiment, the bib is attached to a highchair by first wrapping the bib around the base of the highchair and pulling the drawstrings around the back. In one embodiment, the front of the bib is under the leg rest, as shown in FIG. 5A. In an alternative embodiment the front of the bib is over the leg rest, as shown in FIG. 5B. Tie the drawstrings together in the back to secure the highchair bib, as shown in FIG. 5C. Attach the bottom of the adjustable highchair bib with the hook and loop (e.g. Velcro®) attachments, shown in FIG. 5D. When adjusted correctly, there will be a "gutter" to catch food. If necessary, adjust the highchair bib so that it hangs level with the floor. A correctly attached bib is shown in FIGS. 5E and 5F.

Example 2

Attaching Bib to Chair

In another embodiment, the bib is attached to a conventional chair, such as at a restraint, as substantially described in Example 1. Inner rim 18 is secured near the edge of the seat, or at the base of a booster seat if one is used.

Example 3

Attaching Bib to Highchair, Continuous Outer Rim

In an embodiment, the bib is attached to a highchair by unfolding the outer rim accordion style, similar to how many automobile sun shades unfold. The outer rim is placed over the chair so that it is below the chair seat. The inner rim is secured near the seat by tying the draw strings together in the back to secure the bib. When attached correctly, there will be a "gutter" to catch food and the bib will look substantially like FIGS. 5E and 5F.

The invention claimed is:

1. A debris catching apparatus for securing to a chair wherein the chair has a chair seat, an outer perimeter, and a lower portion, the debris catching apparatus comprising an inner rim with a top, a receiver, an outer rim, an outer lip, and a top fastening mechanism, wherein the apparatus comprises a front portion, two side portions and a rear portion, wherein the inner rim is adapted to be secured to the chair near the chair seat the top fastening mechanism, wherein the receiver comprises an expanse of material extending between the inner rim and the outer rim, wherein the outer rim is lower than the inner rim when secured to the chair such that the expanse of material between the inner rim and outer rim extends downward at an angle of greater than 45 degrees from a horizontal plane extending from the top of the inner rim, wherein the outer rim is greater in circumference than the inner rim so that the receiver and outer rim extend substantially beyond the outer perimeter of the chair, wherein the outer lip extends upwards from the outer rim at least along the side and front portions of the apparatus, wherein the inner rim comprises an opening that allows the lower portion of the chair to be encircled, wherein the inner rim comprises the top fastening mechanism on each side of the opening, and, wherein the outer rim is substantially circular and comprises a continuous piece of spring steel with no opening.

* * * * *